US007495581B2

(12) United States Patent
Horst et al.

(10) Patent No.: US 7,495,581 B2
(45) Date of Patent: Feb. 24, 2009

(54) AUTOMATIC MARINE SIGNALING SYSTEM

(76) Inventors: David J. Horst, 2312 Martin Dr., Baltimore, MD (US) 21221; Jerry A. Carr, 216 Fox Haven Ct., Reisterstown, MD (US) 21136

( * ) Notice: Subject to any disclaimer, the term of this patent is extended or adjusted under 35 U.S.C. 154(b) by 171 days.

(21) Appl. No.: 11/394,444

(22) Filed: Mar. 31, 2006

(65) Prior Publication Data

US 2007/0241937 A1 Oct. 18, 2007

Related U.S. Application Data

(60) Provisional application No. 60/666,495, filed on Mar. 31, 2005.

(51) Int. Cl.
*G08B 23/00* (2006.01)

(52) U.S. Cl. ..... 340/984; 340/384.7; 114/382

(58) Field of Classification Search ..... 340/984
See application file for complete search history.

(56) References Cited

U.S. PATENT DOCUMENTS 3,684,895 A * 8/1972 Edelson ..... 307/132 E
3,786,498 A * 1/1974 Lipe et al. ..... 340/474
4,630,208 A * 12/1986 Le Pechon ..... 701/200
4,847,530 A * 7/1989 English et al. ..... 313/25
5,012,757 A * 5/1991 Williams ..... 116/19
5,072,362 A * 12/1991 Lilienthal ..... 340/984
5,448,234 A 9/1995 Harwood
5,890,794 A * 4/1999 Abtahi et al. ..... 362/294
6,473,005 B2 * 10/2002 Showell ..... 340/984
6,972,697 B2 * 12/2005 Vogel et al. ..... 340/984
7,023,338 B1 * 4/2006 Foth ..... 340/539.13
7,138,945 B1 * 11/2006 Newman et al. ..... 342/357.17
7,174,154 B2 * 2/2007 Ehlers ..... 455/404.2
2004/0075587 A1 * 4/2004 Vogel et al. ..... 340/985

* cited by examiner

*Primary Examiner*—Eric M Blount
(74) *Attorney, Agent, or Firm*—Ober/Kaler; Royal W. Craig

(57) ABSTRACT

A system for controlling a marine vessel's existing horn to automatically sound navigational signals as set forth in Coast Guard Navigation Rules, International and Inland for Sound and Light Signals for boats 12 meters 39 feet and larger, Rules 34 through 37. The system provides a user-interface with a selection of predetermined horn/light signals that can be repeated once or continuously via lights and/or sound, with a preview of the selected signal. The system permits a helmsman and other crew members to attend to other duties without constant attention to the vessel's horn, and enhances safety and Coast Guard compliance, and in the long term helps to inform and educate the operator through observing the signal patterns, on the water, or in boating courses like Coast Guard Auxiliary, Power Squadron and Community College courses.

5 Claims, 10 Drawing Sheets

LD23, SW1, IC1→IC2, D1→D2, R25→R29, C2→C5, L1→L2

LDL1→LD20, C1 R1→R24, Q1

Sound Signals for Restricted Visibility

Power Making Way _____
(4-6 seconds)

Power Not Making Way _____ 2sec _____
(4-6 sec) (4-6 sec)

NUC, RAM, Sail, Fish, Towing _____ _ _
(4-6 sec) (1) (1)

NUC- Not Under Command
RAM- Restricted Ability to Maneuver

Towed and Manned _____ _ _ _
(4-6 sec) (1) (1) (1)

Anchored _ _____ _
(1) (4-6 sec) (1)

Sound and Light Signals for Warning, Distress, Maneuvering

Danger / Doubt . . . . . 1/3 sec On, 1/3 sec off
( 3 sec )

S.O.S. Continuous blast or . . . _ _ _ . . .
1/3 sec on (1) (1) (1)
1/3 sec off

S.O.S. (Inland Only) 50-70 flashes per minute

Maneuvering; _ to starboard
(1)

_ _ to port
(1) (1)

_ _ _ astern propulsion
(1) (1) (1)

Fig. 5

AUTOMATIC MARINE SIGNALING SYSTEM

CROSS-REFERENCE TO RELATED APPLICATION(S)

The present application derives priority from U.S. provisional application No. 60/666,495 filed Mar. 31, 2005.

BACKGROUND OF THE INVENTION

1. Field of the Invention

The present invention relates to marine navigation systems and, more particularly, to a system for automating the horn/light signaling of marine vessels in accordance with Coast Guard Regulations, which provides for selection of regulation cadences via a convenient user-interface, and which allows said cadences to be repeated once or continuously, with a preview of the selected signal.

2. Description of the Background

All marine vessels are required by Coast Guard Regulation to carry sound signaling appliances and lights, and certain vessels are further required to make specified signals in specified situations. Proper sound signals are required for power and sailboats of 12 meter or more 39 feet 4½ "and larger. Pursuant to U.S. Coast Guard Navigation Rules International & Inland COMDTINST M16672.2D, Rules 32-37, operators are required to make specified signals in specified situations. For example, one of the main uses of this device is Rule 35 Restricted Visibility. There are pluralities of sequenced sound signals that must be repeated at timed intervals. In addition to the Restricted Visibility Rule 35 feature in this device there is also Danger/Doubt signal that can be given once or repeated. If a vessel doubts the safety of a proposed maneuver or fails to understand the intention of another vessel where collision may be at risk shall immediately indicate such doubt by giving at least five short and rapid blasts on the whistle. Such signals may be supplemented by a light signal. Rule 34. Furthermore, the device also provides a means of sending S.O.S signals either once or repeatedly Rule 37. Distress signals can be either a continuous blast or a short-short-short-long-long-long-short-short-short SOS pattern. For Inland use only, a high intensity white light flashing at regular intervals from 50 to 70 times per minute as allowed. Unfortunately, it is often not possible to maintain the sequence and time intervals called out in the regulations for Restricted Visibility, or in the need of assistance or distress, especially when attention is needed for other operating details. While boats less than 39 feet are not obliged to give the specified sound signals, they are required to give efficient sound signals as needed at prescribed intervals. Most of the smaller boats have 12-volt horns, but most operators simply do not know the proper signaling patterns.

In all such cases, these signaling patterns are complex, difficult to remember, and often ignored by recreational boaters. The general concept of automated horn signaling with an electronic control module is known. All of the following references do it in some manner, albeit most are fairly cumbersome.

U.S. Pat. No. 5,012,757 to Williams issued May 7, 1991 discloses an automatic horn warning signal apparatus for use on boats, which is manually selectable actuated for automatically sounding any of nine predetermined patterns of warning horn signal sequences applicable to specified, recognized navigational procedures for marine craft. The device is mechanical in that a small motor operates a camshaft containing nine lobed cams each having a different configuration corresponding to the desired warning signal pattern to be sounded. The camshaft actuates a valve for releasing pulses of compressed gas into the horn.

U.S. Pat. No. 5,448,234 to Harwood issued Sep. 5, 1995 shows a logical light control for sailing vessels to improve the method by which the operator selects the desired light combination, thereby eliminating the possibility of improper light combinations and reducing the probability that the vessel will display a currently incorrect light combination. This patent is narrowly drawn to the circuitry that actuates light patterns without the possibility of displaying an improper combination of lights.

U.S. Pat. No. 5,072,362 to Lilienthal issued Dec. 10, 1991 expired shows an apparatus for controlling a vessel's horn, any of which may be selected by pressing an appropriate key on a keypad. The apparatus includes fog modes that will automatically repeat an appropriate horn signal within a predetermined period of time. The structure of this device uses a microcontroller, albeit a different user keypad is employed.

U.S. Pat. No. 6,473,005 to Showell issued Oct. 29, 2002 shows a marine signaling device that provides a user-interface that is functionally and operationally similar to the directional devices i.e., turn signal devices found in automobiles, thereby reducing the dependency of the vessel operator on his or her memorization of the applicable marine regulations.

United States Patent Application No. 20040075587 by Vogel, David A. et al. published Apr. 22, 2004 discloses a controller for automatically manipulating a horn signal for navigational purposes that automatically operates a vessel's horn as a foghorn. The horn controller automatically causes the vessel's horn to sound according to the proper foghorn-sounding schedule. The horn controller is designed to be installed in a new vessel, and/or to be retrofitted to an existing vessel. This patent is trade marked as FogMate and is commercially available. FogMate is a device that works with existing horn and helm switches to ensure automatic, regular timing of Rule 35 patterns. It is produced by TSX Products Corporation, Norwood, Mass. The user turns on the navigation lights either "underway" or "at anchor" to activate the FogMate controller, and then presses the horn switch in the appropriate pattern within three seconds of activating the FogMate controller to repeat the pattern. The operator must know and input the proper sequence for the required situation in order for the unit to repeat and output the proper signal. The FogMate will respond with very short blasts of the horn to acknowledge the count, and then start the selected blast pattern a few seconds later. There is no graphical control panel or preview to assure correct signaling has been chosen.

Again, the foregoing references are fairly cumbersome, requiring nine different wiring configurations to accomplish their purposes. Hence, they are not user-friendly.

It would be greatly advantageous to provide a more efficient system for automating the horn/light signaling with an electronic control module that can be retrofit or OEM installed into the existing vessel circuitry. The control module is programmed to automate signaling of both horn and/or lights in accordance with the Coast Guard Regulations. The specified sequences can be repeated once or continuously via sound and/or lights, with a preview of the selected signal. All of the regulation cadences can be readily selected by a convenient user-interface.

SUMMARY OF THE INVENTION

It is, therefore, an object of the present invention to provide a system for automating the horn/light signaling of marine vessels that can be retrofit or OEM installed into the existing vessel circuitry, and will automate signaling of both horn and/or lights in accordance with the Coast Guard Regulations.

These and other objects are accomplished by the present invention, which is a system for controlling a marine vessel's existing horn and 360 degree light through two independent outputs to automatically give the required sound and light navigational signals as set forth in Coast Guard Navigation Rules, International and Inland for Sound and Light Signals for boats 12 meters 39 feet and larger, Rules 34 through 37. According to the regulations at times, the horn and light must be used separately. At other times, the horn and light can be used together if synchronized. Therefore two independent outputs are necessary. The use of the second independent output for a 360 degree masthead light can be used to supplement if synchronized the sound signals for Rules 34 Maneuvering and Warning Signals, Rule 36 Signals to Attract Attention, & Rule 37 Distress Signals. The said invention utilizes a second independent output on the controller to be used with a 360-degree light for both daytime and nighttime maneuvering which makes the controller unique. It is this second independent output that makes the controller capable of synchronizing the horn with a 360-degree light which is required by the regulations if you want to supplement the horn with a light. The difficulty of synchronizing of horn and light makes this provision in the regulations hard to implement.

For example by wiring a horn in parallel with the light on a single output would cause incorrect signaling during the Rule 35 Restricted Visibility usage in which a light is not permitted to be used. This single output wired in parallel would also prohibit the use of a 360-degree light such as an anchor light to be used for night maneuvering. This would cause conflict with the horn while trying to use the anchor light. By having the option of supplementing the horn with a 360 degree light for night time and day time signaling would greatly enhance communication between vessels during maneuvering and warning situations, thus reducing vessel collisions.

Rule 35 Restricted Visibility, requires the largest number of different horn signal sequences and is difficult to remember and execute in a timely manner. The signals for Rule 35 are sound signals, although Rules 34, 36, 37 allow vessels use a 360-degree light to supplement the sound. The present apparatus provides a selection of predetermined horn/light signals, by pressing an appropriate key on a convenient user-interface. The specified sequences can be repeated once or continuously via sound and/or light, with a preview of the selected signal. The system permits a helmsman and other crew-members to attend to other duties without constant attention to the vessel's horn. Use of the system enhances safety and Coast Guard compliance, and in the long term helps to inform and educate the operator through observation of the signal patterns displayed on the keypad, and would be welcomed in boating educational courses like Coast Guard Auxiliary, Power Squadron and Community College courses. In an alternative embodiment a portable self-contained version is provided that contains both a horn and a 360-degree light along with the present system controller, all housed in an emergency abandon ship bag. The portable version is available for sailboats, towboats, water taxis, dinghies, etc.

The light designed to accompany the said invention is a high intensity white 360-degree Light Emitting Diode LED which has more than a two-mile visibility. This high intensity LED circuitry requires an aluminum heat sink base to dissipate the heat and utilizes a 120-degree reflective aluminum cone to redirect any stray light emissions.

BRIEF DESCRIPTION OF THE DRAWINGS

Other objects, features, and advantages of the present invention will become more apparent from the following detailed description of the preferred embodiment and certain modifications thereof when taken together with the accompanying drawings in which:

FIG. 5 is a perspective drawing of the actual output signaling sequences of the present invention.

DETAILED DESCRIPTION OF THE PREFERRED EMBODIMENTS

The present invention is a system for automating the horn/light signaling of marine vessels in accordance with Coast Guard Regulations, which provides for selection of regulation cadences via a convenient user-interface, and which allows said cadences to be repeated once or continuously, with a preview of the selected signal.

Figure 1:
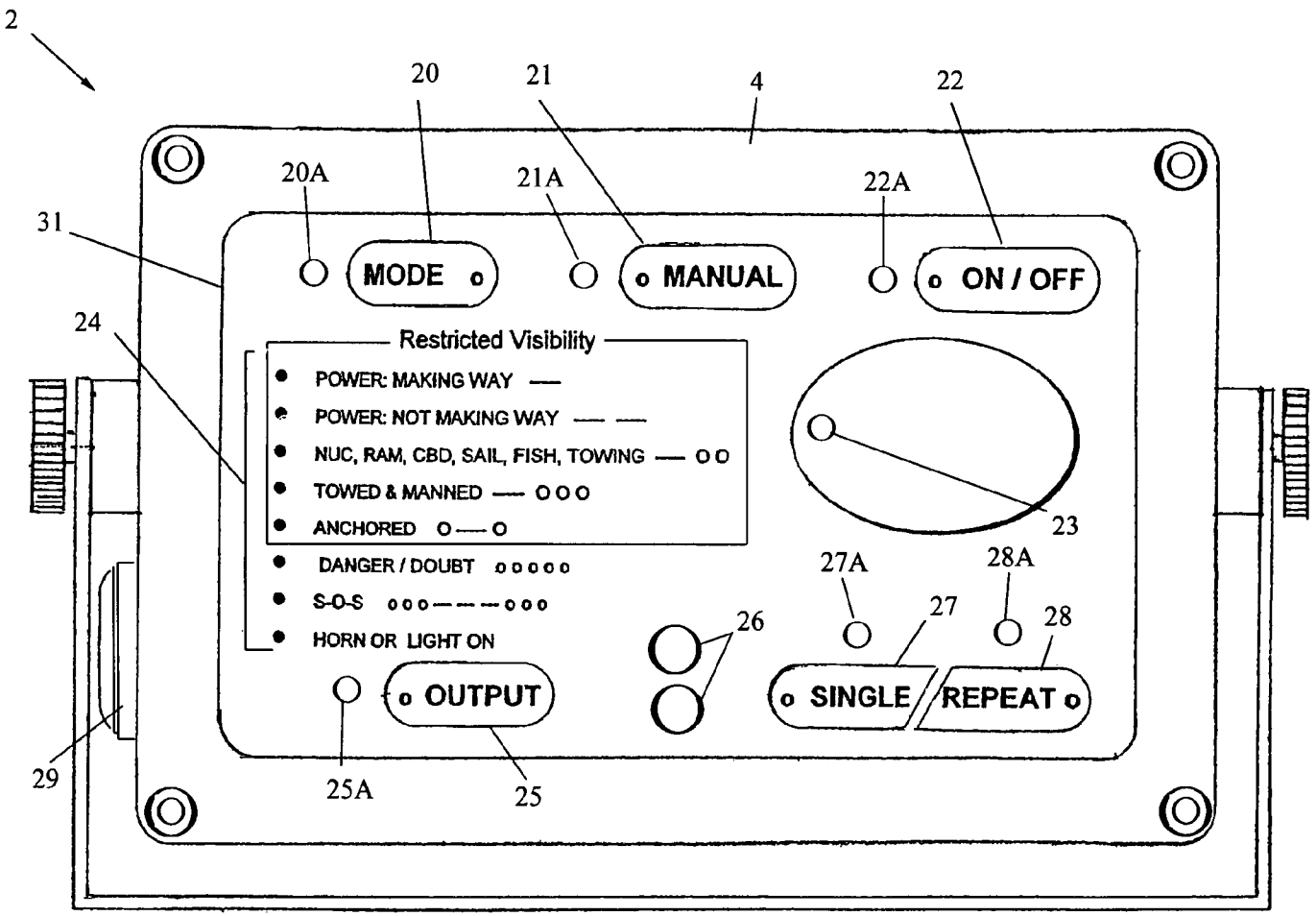
FIG. 1 is a front view of the system 2 illustrating the user interface 31.

FIG. 1 is a front view of the system 2 illustrating the user interface 31. The system includes a compact; rugged, powder coated aluminum enclosure 4, that is splash proof, with front-mounted user interface 31. A light-sensing window 23 turns on backlighting automatically and during low lighting. A panel mount 12-volt output receptacle 29 is provided for use with a spotlight to automate the signal for in danger or distress SOS mode situations. The user interface 31 comprises a backlit molded silicon rubber keypad with a plurality of lighted indicators and pressure-switches. At the top, the pressure switches include three discrete selector switches 20-22 inclusive of a MODE switch 20, MANUAL switch 21, and ON/OFF switch 22. The MODE switch 20 selects certain automatic modes and functions for vessel signaling, and is indicated by the illumination of LED 20A. The selected automatic mode is indicated by a plurality of lighted mode legends 24 appearing directly beneath. The MANUAL switch 21 overrides program flow and allows manual turning of the signals on/off. If the MANUAL switch 21 is actuated the MANUAL LED 21 A will illuminate and program flow is interrupted and the action is interpreted as a command to activate the horn and/or mast light. The ON/OFF switch 22 controls overall power to the system 2, with the ON/OFF LED 22A illuminating when on. The automatic modes as indicated by the mode legends 24 include: 1) Power: Making Way; 2) Power: Not Making Way; 3) NUC, RAM, SAIL, FISHING, TOWING; 4) TOWED & MANNED; 5) ANCHORED; 6) DANGER/DOUBT; 7) S.O.S. with Inland Distress included; 8) HORN OR LIGHT ON. Each of these modes reflects a vessel condition for which a particular horn signal must be sounded in accordance with Coast Guard Navigation Rules. The particular mode can be set by pushing the MODE switch 20, which changes modes one-by-one, the selected mode being indicated by illumination of the corresponding mode legend LED's 24, and the chosen horn signal being graphically illustrated to the right. Once a selected mode is chosen, the output can be set to: a No output, monitor only, b Horn only; c Light only; or d both Horn and light, which will then illuminate the graphic legend 26 for the chosen output. The desired output signaling will start with the press of either the single or the repeat button. The system 2 will output either the horn or masthead light or both with an assigned sequence of long or short blasts.

FIG. 5 is a perspective drawing of the actual output signaling sequences of the present invention. This example gives the required blast duration for a prolonged blast 4-6 seconds a short 1 second and rapid blast ⅓ second. Sequences are emitted as shown for the following signals, with blasts of controlled patterns over set time frames as shown:

1 Power: Making Way _____

2 Power: Not Making Way _____ _____

3 NUC,RAM,Sail,Fish,Towing _____ _ _

4 Towed & Manned _____ _ _ _

5 Anchored _ _____ _

6 Danger/Doubt . . .

7 S.O.S. . . . _ _ _ . . . or Inland Distress, (50-70 flashes per minute)

8 Horn or Light on continuously

Referring back to FIG. 1, at the bottom of the interface 31, an OUTPUT switch 25 is provided in conjunction with a LIGHT legend and HORN legend 26. The OUTPUT switch 25 LED 25A will illuminate when pressed and allow the operator to choose to emit the signaling via horn, mast light, or both or no output i.e., monitor sequence. The particular selection can be set by pressing the OUTPUT switch 25, which changes the output to horn and/or mast light, the selected output being indicated by illumination of one or both of the corresponding LIGHT legend and/or HORN legend 26 or neither illuminated Monitor output only. Once the single or repeat switch is pressed the chosen output will receive output sequence. If no outputs are chosen the OUTPUT LED 25A will flash the chosen signal pattern for the operated to monitor. The OUTPUT LED 25A will always reflect the chosen pattern regardless of the output chosen, which lets you know the sequencer is working.

Finally, a SINGLE switch 27 is provided along with a REPEAT switch 28. Pressing the SINGLE switch 27 illuminates LED 27A and results in a single occurrence of the selected sequence. Pressing the REPEAT switch 28 illuminates LED 28A resulting in continuous and repetitive sequences with the proper time intervals. Either the SINGLE switch 27 or the REPEAT switch 28 may be depressed, the corresponding LED 27A, 28A being lit to indicate which has been depressed. The above-described user-interface 31 is highly intuitive and convenient and substantially eliminates the incidence of operator error.

Figure 6:
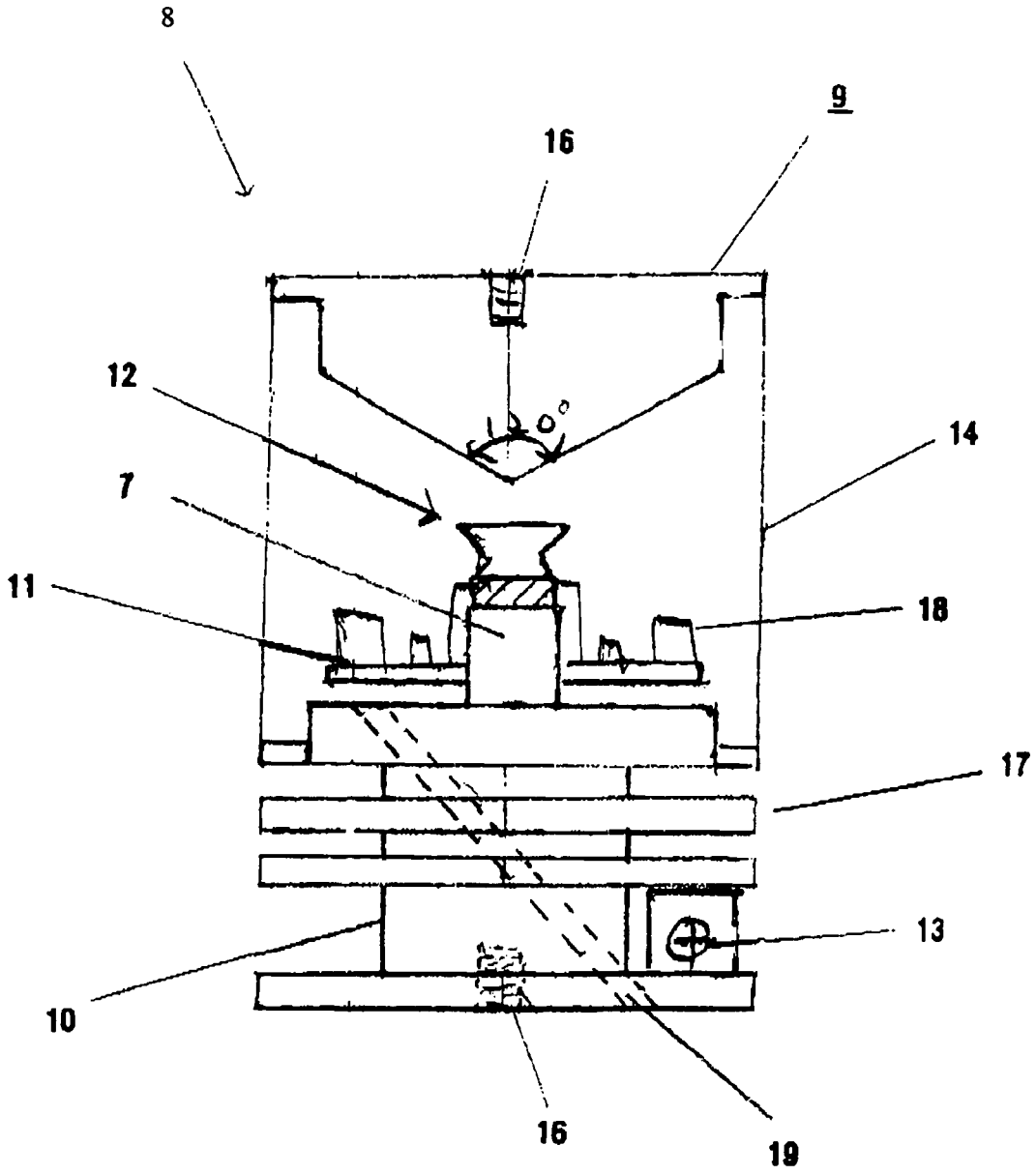
FIG. 6 is a cross section view of an exemplary embodiment of the remote light system 8.

In addition to the user interface 31 of FIG. 1, the system 2 includes a remote light system 8 as shown in FIG. 6, connected to the user interface 31 for emitting high intensity light in a 360-degree pattern visible for more than two nautical miles. The light system 8 comprises an aluminum base 10 that supports and maintains thermal contact with the base of a high-intensity LED 12. The top of the base 10 has a pedestal 7 that allows a donut shaped Printed Circuit Board PCB 11 to be slipped over the pedestal 7 and attached to the LED 12. Printed Circuit Board PCB 11 contains conventional LED driver circuitry. The aluminum base 10 is required for heat dissipation that the high intensity LED emits. The base 10 is preferably provided with spaced fins 17 to increase surface area for heat dissipation and to provide airflow to remove heat from the base 10. The LED 12 is a high intensity side emitting diode viewed from 360 degrees. A polished aluminum reflector cone 9 is attached to the acrylic tube 14 and this provides a 120-degree reflective surface to redirect any illuminations radiating from the top of the LED 12. This reflected light is redirected to the sides and outward as usable light. The raised pedestal 7 on top the base 10 has two purposes. First it allows the LED 12 to be directly thermally attached to the heat sink base 10 while allowing the PCB 11 to be placed over the pedestal 7 and attached to LED 12. Secondly, this raising of the LED 12 positions the PCB 11 components well below the horizontal plane to increase the viewing angle of LED 12. Similarly, the height of the aluminum reflector cone 9 in relation to the LED 12 also increases the viewing angle due to the reflected angle of the aluminum cone 9. This additional viewing angle becomes important during the vessel's motion, and can increase the viewing angle by 30 degrees. The reflector cone 9 serves as the top of system 8 and it is tapped 16 for a #10-24 thumbscrew to be used for hoisting or securing the system 8 if desired. The base 10 also is tapped 16 for a #10-24 thumbscrew for securing the system 8 to the deck. The reflector cone 9 and the base 10 are jointed together using 1¼ "clear acrylic tube 14 and clear adhesive to seal the unit. The system 8 accepts 12 volts and current regulates using PCB 11. This current regulation design allows the light intensity output of system 8 to remain constant as the voltage drops and until the battery voltage goes below 8.5 volts. In contrast, an incandescing light will diminish in light intensity while the battery is being depleted. The light intensity output of system 8 is adjustable using a trimming potentiometer 13 to set the desired illumination. This adjustment of illumination allows the intensity to be increased for signaling high intensity, or decreased to conserve battery consumption such as an anchor light or for cabin illumination low intensity. The system 8 uses a photoconductive cell 18 mounted on PCB 11 to automatically turn on the LED 12 at dusk or low light conditions, and off during daylight. The photoconductive cell 18 can easily be covered with a black piece of tape to keep the system 8 to remain on regardless of ambient light conditions. The supply voltage wires and the light intensity adjustment wirers 13 are run through a guide hole 19 running through the base 10 at a 45 degree angle 19 and exiting on the top of the base 10 for termination at PCB 11. The bottom of the base 10 is slotted from the guide hole 19 to the outer edge of the bottom of the base 10 to allow the wires to hang down for from 19 for hoisting, or to bend at a 90 degree angle in relation to the bottom of the base 10 for flush bottom mounting. Flush mounting can be accomplished using industrial double sided tape, hook and loop products, or using the #10-24 tapped hole 16 for secure vertical or horizontal mounting. The wires in guide hole 19 are preferably sealed with potting material to seal out atmosphere. The above system 8 can be used to accompany the controller of FIG. 1 for supplementing the horn with a 360-degree light as allowed in the Rules 34, Maneuvering and Warning Signals; Rule 36, Signal to Attract Attention; Rule 37, Distress Signals. The remote light system 8 provides the capability of signaling with horn and or light as necessary.

Figure 2:
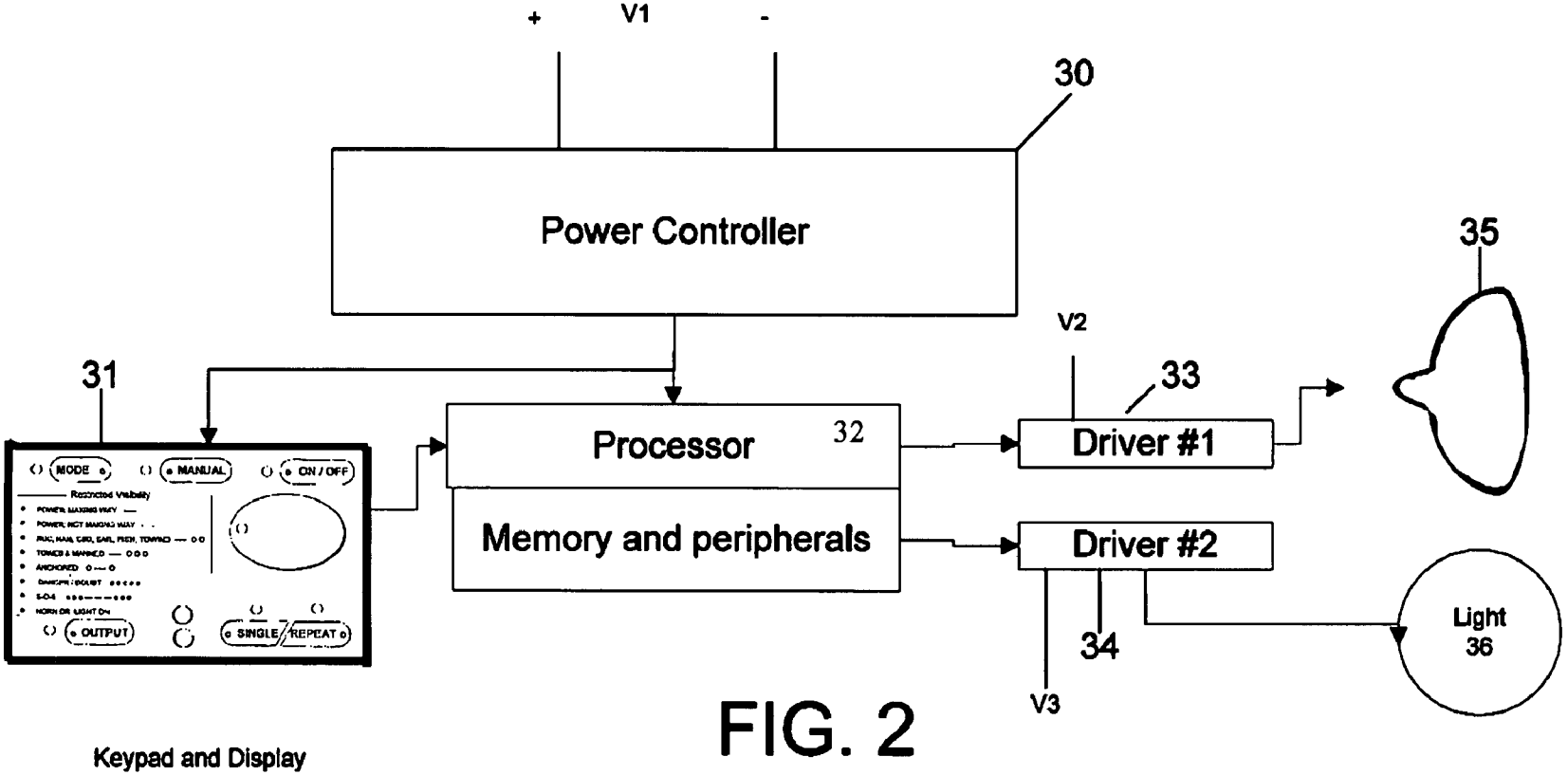
FIG. 2 is a block diagram of the entire system 2.

FIG. 2 is a block diagram of the electronics of the Vessel Signaling System 2. The electronics comprise a power controller 30 a keypad and display 31, a digital processor with self-contained memory 32, two identical drivers 33 and 34, a horn 35 and the above-described remote light system 8.

The power controller 30 accepts unregulated dc voltage V1 from the vessel's power source and regulates, filters and controls the application of the power to the keypad/display 31 and the processor 32. It also provides the on/off control for the Vessel Signaling System 2. On/Off control is provided by IC8 a small microprocessor PIC10F200 and a p-channel FET switch. In operation, closure of the switch is sensed by an input port of the microprocessor, and a preset count started. If the closure persists for the duration of the count the output port of the microprocessor changes state and the FET switch adopts conduction or non-conduction depending upon its previous state.

The keypad and display 31 is the integrated user interface, which accepts key commands from the user and presents information to the user. It comprises the multiplicity of keys described above, which the user may depress to select the modes and functions for the Vessel Signaling System 2.

Processor 32 monitors the keys on the keypad 31 for user actions and interprets them as commands for certain actions to be performed by the processor. It responds to the user by illuminating appropriate LED's, which convey the current state of the system to the user. The processor utilizes a firmware program contained within memory to store the current state of the system, translate user desires into system actions and signals based upon the current system state and select the appropriate driver or drivers 33 and 34 to emit the desired signal. One or both drivers may be utilized at the same time to cause a horn 35 or a light 36 or both to emit the desired signal. The eight distinct signals described above can be generated automatically by the system under the control of the processor 32.

The Drivers 33 and 34 are high side FETswitches that may be powered from the same or a different dc power source V2 and V3 than the remainder of the system depending upon the power requirements of the horn and light.

In FIG. 3(A-D) one implementation of the Boat Signaling System is depicted. Other circuit configurations are possible but FIG. 3 will be used to explain the operation of the system. FIG. 3A illustrates the power regulation components. Assuming a 12-volt supply is provided at terminals 1 and 2, IC2 and associated components regulates the incoming voltage to a constant 5 volts, which powers the system circuitry inclusive of processor 31 of FIG. 2. In the present embodiment the processor 31 comprises a first microprocessor IC8 (a PIC10F200). Actuation of switch S6 causes the microprocessor IC8 described earlier to change state causing the logic level of the output of the processor to go low. The low turns on transistor Q2 allowing current to flow into the circuitry until the voltage reaches approximately 4.5 volts at which time the processor IC5 begins to function. During this time the oscillator within the microprocessor has started running at a frequency of 32 to 33 kilohertz.

Figure 3A:
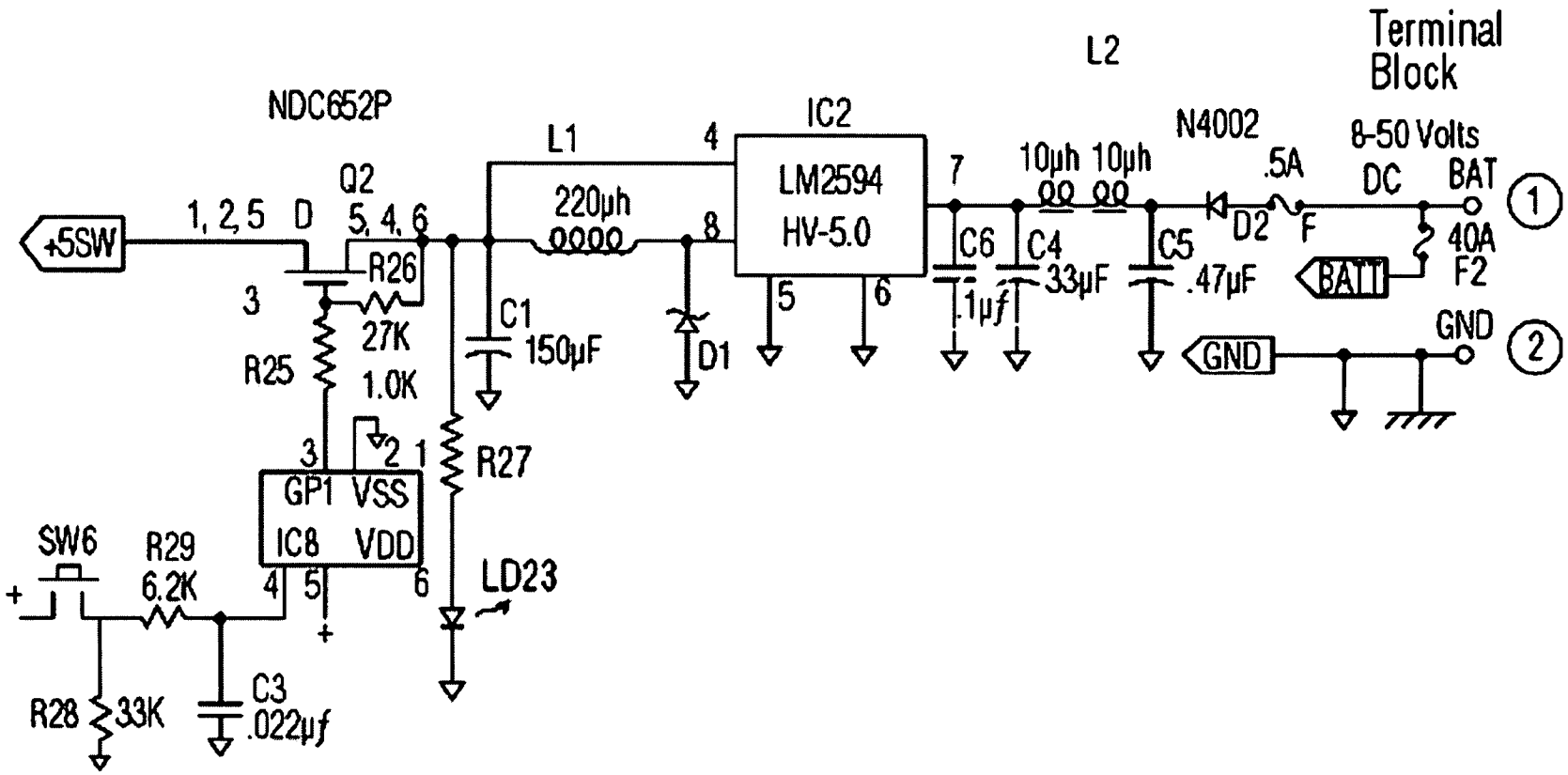
FIG. 3 is a schematic diagram of an exemplary embodiment of the system 2 electronics.
Figure 3B:
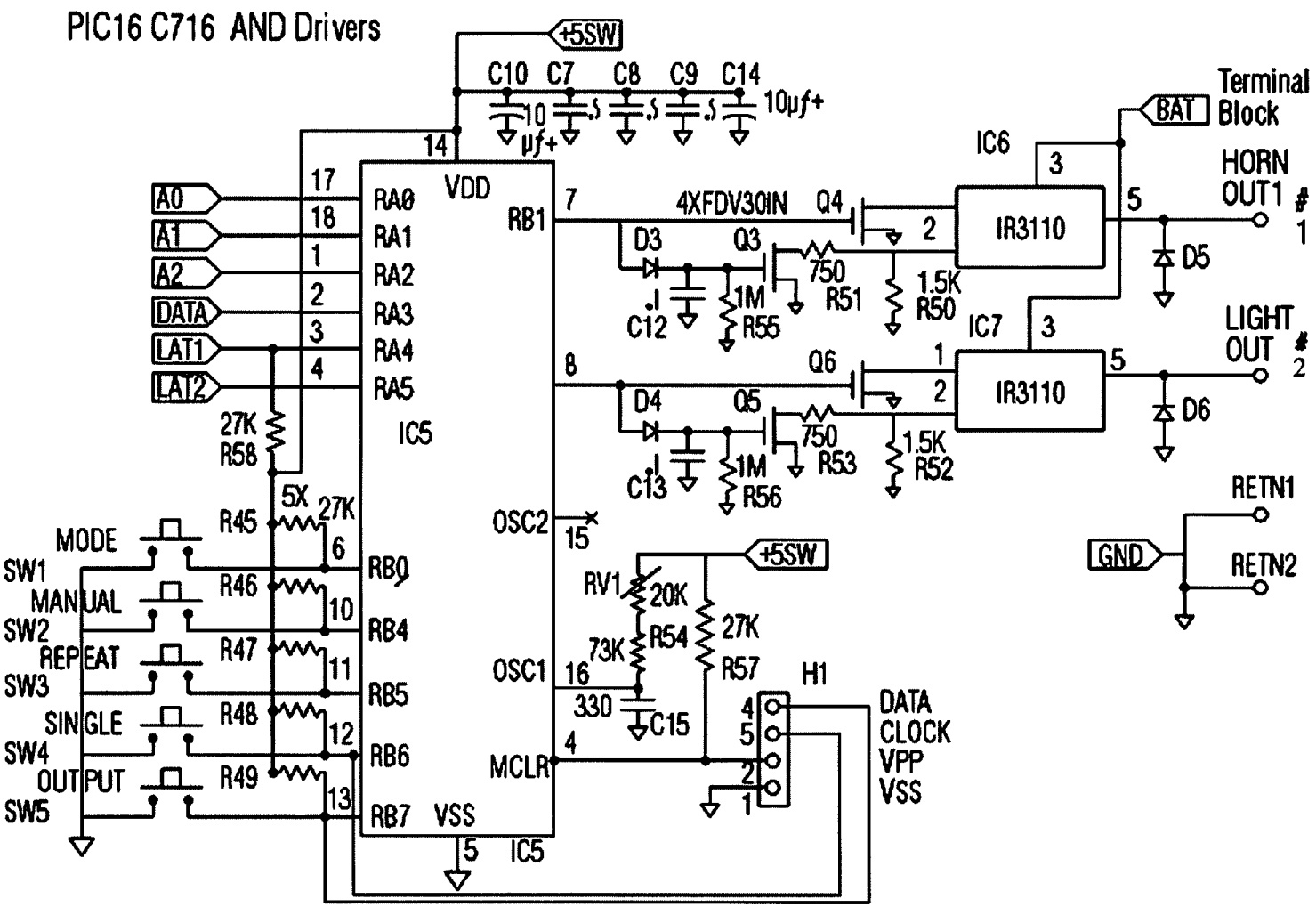
Figure 3C:
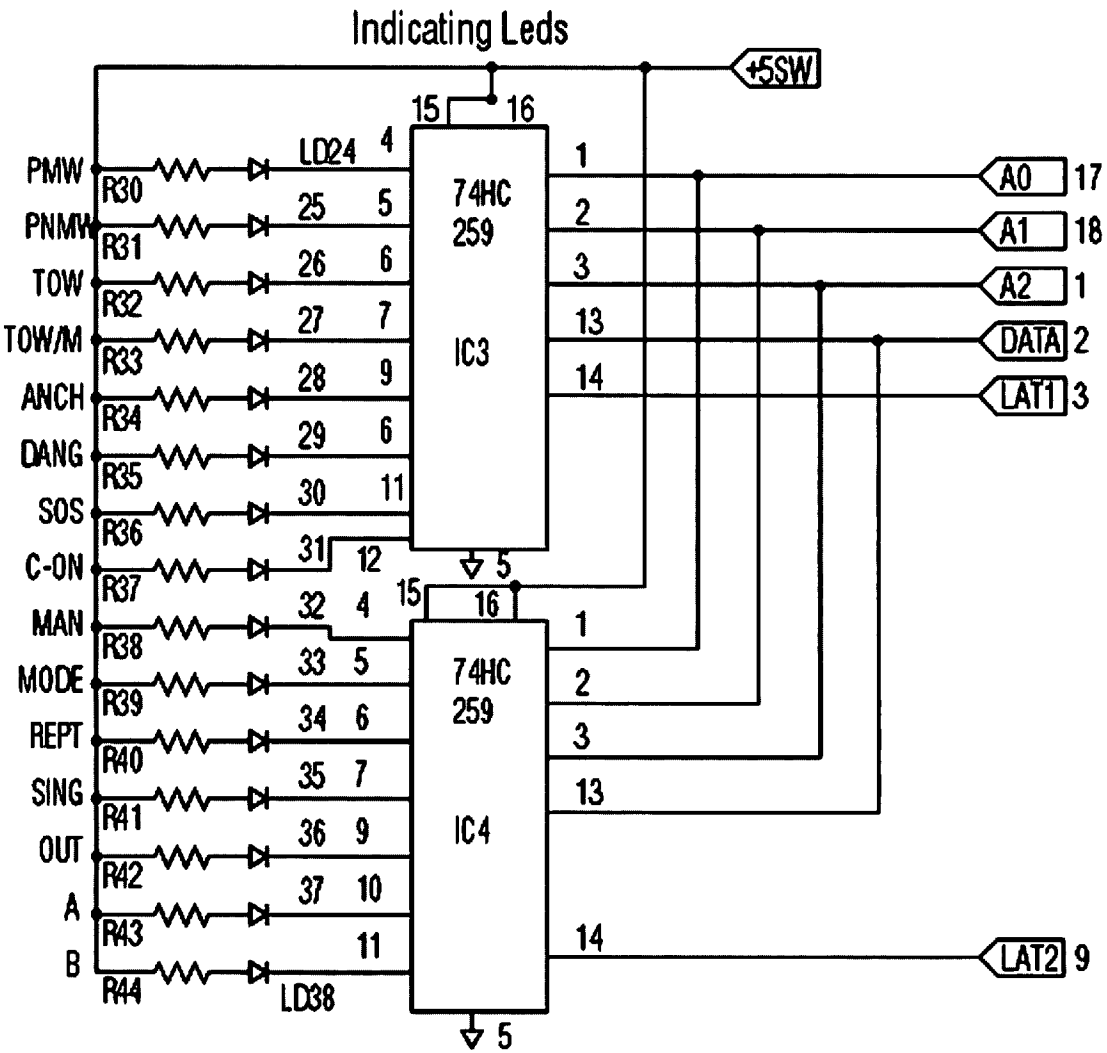
Figure 3D:
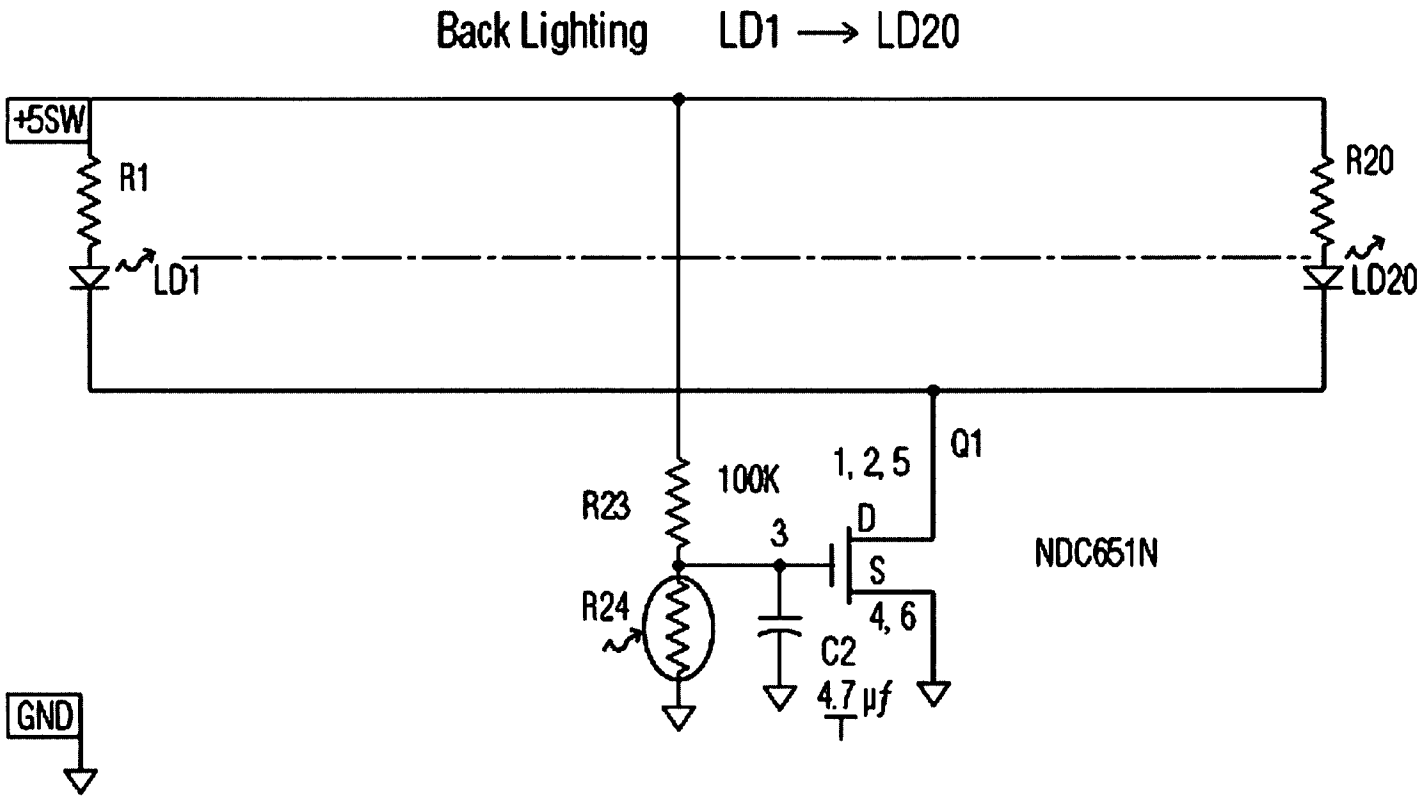

FIG. 3B is a continuation of the schematic of 3A. With regard to FIG. 3B, as the microprocessor runs, the frequency is determined by the resistance of RV1, R54 and C15. After an appropriate number of cycles of the oscillator, the microprocessor IC5 begins to execute its program. It initializes the registers of the microprocessor IC5 and commences to execute the executive program loop. At startup the Manual, Output and Horn LED's 21A, 25A and 26 are illuminated and the program loops until the user actuates one of the switches S1, S2 or S5. The program disregards actuation of switches S3 and S4 at this time. If the Manual switch S2 is actuated, the program flow is interrupted and the action is interpreted as a command to turn on one or both of the Drivers IC6 and IC7 which will result in a signal being emitted. When S2 is released the program will turn the Drivers IC6, IC7 off and the signal will cease. If the Mode switch S1 is actuated the program will deactivate the Manual function and enable the selection of a suitable signal. This state is indicated to the user by the Manual LED 21 B being extinguished and the Mode LED 20A and Power Making Way LED's being illuminated. Further actuations of the Mode switch S1 will cause the signaling modes to be selected in sequence. Back lighting is accomplished during periods of low light using a photocell R24 with Q1 circuit to illuminate the laser etched writing in the translucent silicon rubber material. To activate a mode either the Single or Repeat switch S4, S3 is pressed resulting in a single or continuous operation of the horn, lighting system 8 LED or both in synchronism with illumination of the front panel output LED so that the signal may be monitored at the front panel 31.

FIG. 3B illustrates the second microprocessor of 31, and associated drivers. A stored program in a second microprocessor IC5 (a PIC 16C71) receives the input from switches S1 through S5 as interrupts to be serviced according to the associated program instructions.

The outputs RB1 and RB2 on pins 7, 8 of microprocessor IC5 control transistors Q3, Q4, and Q5, Q6 which in turn operate IC6 and IC7 (IC6 and IC7 are identical IR3310 programmable current sensing high side switches, one connected to the vessel horn and one to the mast light or 12 Volt receptacle). The input signal from RB1 And RB2 via transistors Q3 and Q4 and Q5, Q6 work together control the current set for IC6 and IC7. IC6 and IC7 provide two independent 20-amp protected outputs for sounding the horn or lighting the mast light, and the input voltage to the system can range between 8 and 50 volts and is polarity protected.

Each of the MODE switch 20, MANUAL switch 21, REPEAT switch 28, SINGLE switch 27, and OUTPUT switch 25 (FIG. 1) may be illuminated at the user interface by a series of LED's 20A, 21A, 27A and 25A (numbered 4-11 at left in FIG. 3B), which are illuminated by IC4, an 74 HC/HCT259 8-bit addressable latch high-speed CMOS device compatible with low power Schottky TTL logic. Similarly, the various mode legends 24 at the user interface 31 may be illuminated by a series of LED's 4-12 at left, which are illuminated by IC3, another 74HC/HCT259 8-bit addressable latch. At startup, the Manual Switch 21 and Output A Horn 26 LED's are illuminated during manual operation and the program simply loops until one of the MODE switch 20, MANUAL switch 21 or OUTPUT switch 25, is pressed by the user. The program disregards actuation of REPEAT switch 28 and SINGLE switch 27 at this time. If the MANUAL switch 21 is actuated the program flow is interrupted and the action is interpreted as a command to turn on one or both of the Drivers IC6 and IC7, which will result in a horn/mast light signal being emitted. The OUTPUT switch 25 LED will illuminate as well. When MANUAL switch 21 is released the program will turn the Drivers IC6 and IC7 off, and the signals will cease to be emitted and the OUTPUT switch 25 LED will be extinguished. If the MODE switch 20 is actuated the program will deactivate the Manual function and enter the Mode function enabling the selection of a suitable signal sequence as described above. This state is indicated to the user by the MANUAL switch 21 LED being extinguished and the MODE LED 20 and the corresponding mode legend 24 LED being illuminated. Further actuations of the MODE switch 20 will cause the mode legend 24 LED to illuminate in sequence to show that the indicated mode is made available. The output can now be selected and the graphic 26 horn or light will illuminate the chosen output: a) None; the Output LED 25 will reflect the chosen sequence to monitor without the horn or light coming on; b) Horn; c) Light and d) both horn and light. If the user actuates the REPEAT switch 28 the program will generate the selected signal and activate one or both drivers IC6, IC7 to cause the signal to be repeated at timed intervals. The OUTPUT switch 25 LED will illuminate in synchronism with the emitted signal. If the user actuates the SINGLE switch 27 a single repetition of the selected signal will be generated and the OUTPUT switch 25 LED will be in synchronism with the signal emitted. The LED displays are controlled by the microprocessor IC5 writing appropriate data to the addressable latches IC3 and IC4 and latching it. The display is rewritten whenever any switch 20-28 is actuated or any signal sequence is generated. Indicating LED's are red 660 nanometers wavelength LED's that do not interfere with night vision.

Figure 7:
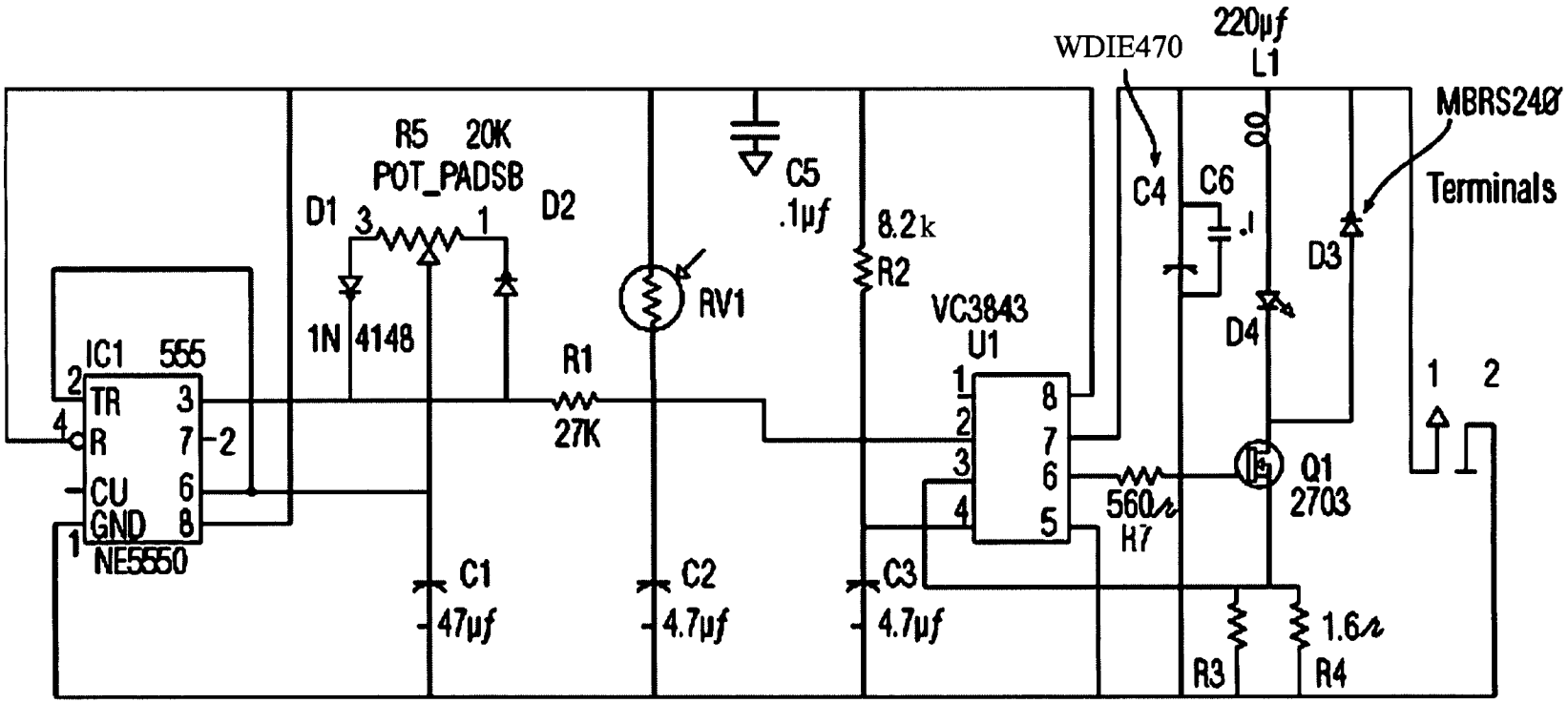
FIG. 7 is a schematic diagram of an exemplary embodiment of the printed circuit board 11.

FIG. 7 illustrates one implementation of the electronics on PCB 11 which is a 360 degree high intensity light system. Other circuit configurations are possible, but FIG. 7 will be used to explain the operation of the system. Assuming a 12-volt supply is provided at terminals 1 and 2, the components R2 and C3 work together for U1 (a UC3843) to operate as a 100 kHz oscillator current mode PWM controller. Each cycle from U1 pin 6 goes though R7 to attenuate the output to Q1. Each cycle of Q1 supplies limited high current from L1 into D4, and out of R3 and R4 to the negative return. The current waveform is set for a 600 ma triangular wave, resulting in half of the average, which is 300 ma the maximum desired current.

The feedback from IC1 555 pin 3 turns Q1 off. This causes the inductive discharge from L1 through D4 and R3/R4, which results in D4 illuminating.

The IC1 is used as an astable oscillator providing 100 Hz pulse with an adjustable duty cycle from 0-100. The frequency and duty cycle are set with R5 and C1. During the charging of IC1 pin 3, the current goes through D2. Similarly during discharge, the current goes through D1.

R1 attenuates the signal into U1 for the on/off operation of Q1 and the high current from L1 into D4. A change of state from IC1 pin 3 to a high turns off Q1 and allows discharge of L1 inductive current and the illumination of D4. Conversely, the change of state from IC1 pin 3 to a low turns on Q1 to and does not allow inductive discharge into D4.

The photoconductive cell RV1 drops in resistance to 200-100 ohms in bright light which turns on Q1 and does not allow current to flow through D4. In darkness, the resistance increases to mega ohms and turns off Q1 allowing the current to flow through D4. This photoconductive cell RV1 senses the ambient light allows D4 to come on automatically during the hours of darkness. This automatic operation is useful for an anchor light or for other situations where reduced battery consumption is desired.

Having described the system 2 architecture, the program flow of the system 2 programmed into microcontroller IC5 of processor 31 will now be described.

Figure 4:
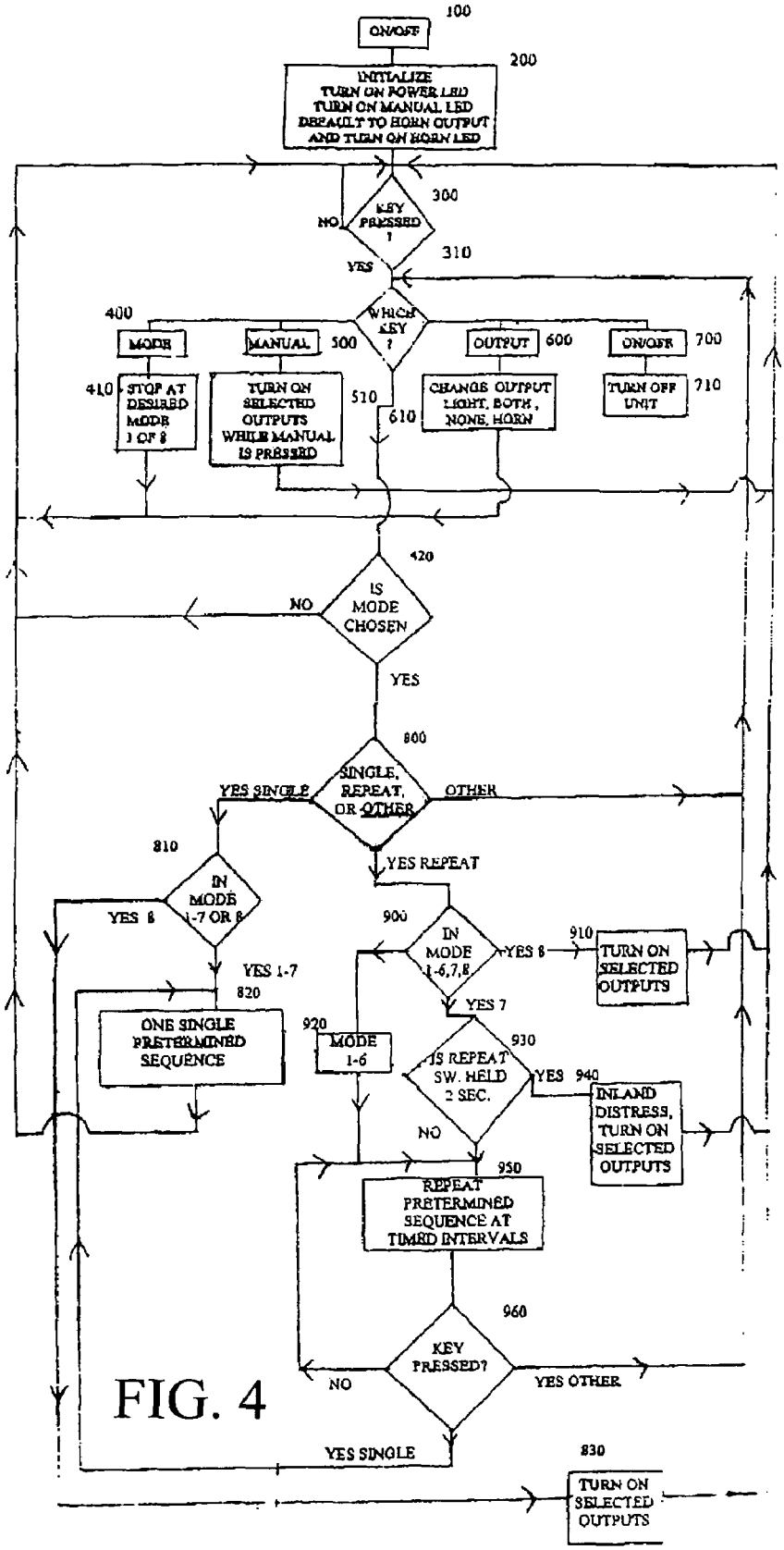
FIG. 4 is a flow diagram of the program flow of the system.

FIG. 4 is a flow diagram of the program flow of the system.

At step 100, the ON/OFF switch 22 is pressed to apply power to the system 2.

At step 200, the system initializes and the ON/OFF switch 22 LED is illuminated along with the MANUAL switch 21 LED. The system 2 defaults to a horn output and the HORN Graphic Display 26 is illuminated.

At step 300 the system waits for a switch closure. If no key has been pressed the system 2 loops back and continues to wait. If a key is pressed, then at step 310 the system 2 determines which of the MODE switch 20, MANUAL switch 21, On/Off switch 22 or OUTPUT switch 25 has been pressed. If a mode has been chosen, and the SINGLE switch 27 or REPEAT switch 28 is pressed, program will fall through 420 and then to 800.

If at 300, the MODE switch 20 has been pressed, program goes to step 400, MODE LED 20 lights and then the various mode legends 24 at the user interface 31 are sequentially illuminated in accordance with the number of MODE switch 20 depressions until the desired mode is attained, and at step 410 that LED will remain illuminated. At step 410 if no other key is depressed the system 2 will loop back to 300 and waits for another key to be pressed. Typically the OUTPUT 26 switch would be pressed to choose the output. At 600 the program will cycle of the outputs with each press, for either the Horn, Light, Horn and Light or None (OUTPUT LED 25 will illuminate for monitoring regardless of chosen output sequences). Once the OUTPUT 600 is chosen, the Graphic Display 26 of the HORN, LIGHT, HORN and LIGHT will illuminate, and the program will loop back to 300 and wait for key press. With system 2 having a mode and output chosen, program waits for a SINGLE 27 or REPEAT 28 to be pressed to begin sequence. The program falls through to 420 and then to 800, where the program determines which key was pressed.

If SINGLE 27 was pressed, SINGLE 27 LED illuminates and program goes to 810 to check for modes 1-7 or mode 8. If in mode 1-7, program fetches sequence and illuminates the chosen mode legend 24 LED, and goes to 820 and executes one sequence of that mode then goes back to 300 and waits. If in mode 8, the mode 8 legend LED is illuminated, and the program goes to 830 and turns ON the HORN and/or LIGHT along with the Graphic Displays 26, then returns to 300 and waits.

If REPEAT 28 was pressed, REPEAT 28 LED is illuminated, and the program goes to 900. At 900, program checks for modes 1-6,7, 8. If in mode 1-6, program goes to 920 to fetch the sequence, and turns on the chosen mode legend 24 LED, and then to 950 to output the sequence. After the first sequence, the program goes to 960 to check for any other key presses. If there are no other key presses, the program loops back to 950 to repeat the sequence at timed intervals. If SINGLE 27 was pressed, the REPEAT 28 LED goes out, and the SINGLE 27 LED is illuminated, and the program goes to 820 and executes the sequence one time then goes back to 300 and waits for key press. If at 960, another key was pressed, program goes to 310 to determine which key was pressed. If at 900, mode 7 was pressed, the mode legend 24 LED illuminates for mode 7 and the program goes to 930 and checks if REPEAT 28 is held for two seconds. If REPEAT 28 has been held for two seconds program goes to 940 to sequence Inland Distress (50-70 blasts/flashes per minute) This is a variation of S.O.S. Distress. If at 930 REPEAT 28 was not held for two seconds, program goes to 950 to execute mode 7. If at 900, mode 8 was pressed, mode legend 24 LED illuminates, and program goes to 910 and turns ON the HORN and/or LIGHT along with Graphic Displays 26 LED's, and then goes to 300 and waits.

At step 300, if MANUAL 21 is pressed, the program goes to 500 and the MANUAL 21 LED illuminates, and the program will turn ON the selected outputs and Graphic Display 26 LED's for as long as the MANUAL 21 key is pressed. The OUTPUT 25 LED will illuminate with each press. When the MANUAL 21 key is released, the outputs turn OFF, and then the program goes to 300 and waits.

At step 300, if OUTPUT 25 is pressed, the program goes to 600 and the OUTPUT 25 LED will illuminate and will cycle through outputs; HORN, LIGHT, HORN and LIGHT, or NONE (monitor OUTPUT LED) with each press along with the Graphic Display 26 LED's. At step 300, if ON/OFF 22 is pressed, program goes to 700 and turns off all indicating LED's and the program goes to 710 and system 2 will power down.

It should now be apparent that the present system fully automates both horn and light signaling of marine vessels in compliance with Coast Guard Regulations, providing for selection of regulation cadences via a convenient user-interface that allows said cadences to be repeated once or at the prescribed time intervals continuously with a preview of the selected signal. This permits the vessel operator to comply with navigational rules for restricted visibility that are mandatory for vessels 39 feet and larger, and prudent for vessels less than 39 feet which are required to provide some efficient sound signaling at specified intervals. The system 2 is designed for both the recreational boaters and commercial vessels i.e. NUC, RAM, sailing, fishing, towing and towed and manned. The high quality silicon rubber splash proof user interface 31 and powder coated aluminum enclosure 4 keep the electronics encapsulated for all weather operation. The system 2 may be included by installation in new vessels or may be retrofit as a console-mount or portable unit.

In an alternative embodiment a portable self-contained version is provided that incorporates the system 2 of FIG. 1, plus 360-degree high intensity light 8 of FIG. 6, plus a compact 12-volt horn, 7 amp-hour battery, and DC charger, all stowed in a high visibility emergency flotation bag. The portable version is preferable for training, sailboats, towboats, water taxis, dinghies, abandon ship bag, etc. In all such cases the system 2 helps to promote a safer maritime environment through education and proper signaling.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

We claim:

1. A system for automating the horn/light signaling of marine vessels in accordance with Coast Guard Navigation Rules, comprising:

a user-interface for manual selection from among a plurality of regulation cadences each reflecting a vessel condition for which a particular horn signal must be sounded in accordance with said Coast Guard Navigation Rules, said user interface including a plurality of switches for allowing said manual selection and further including, a mode switch for incrementally selecting between said plurality of cadences, a plurality of LEDs corresponding to said plurality of cadences, an output selection switch for selecting between horn signaling, light signaling, synchronized horn and light signaling, or no signaling, and for allowing an operator to preview a selected cadence at said user interface before implementing said selected cadence;

a manual switch for interrupting any selected cadence and immediately sounding a horn and/or light in accordance with said output selection switch, a control for allowing selection of a single cadence sequence or repetitive cadence sequences;

a processor with memory in communication with said user-interface switches for determining said manual selection and controlling a selected cadence;

a horn driver in communication with said processor for driving a marine vessel horn in accordance with said selected cadence;

a light driver in communication with said processor for driving a marine vessel light in accordance with said selected cadence;

a power controller for regulating power to said horn driver and said light driver.

2. The system for automating the horn/light signaling of marine vessels according to claim 1, wherein said user interface comprises a backlit molded silicon rubber keypad including said switches, said switches being pressure switches each having a proximate indicator light.

3. The system for automating the horn/light signaling of marine vessels according to claim 1, wherein said MODE switch allows selection of any cadence from among a group comprising:

Power: Making Way;
Power: Not Making Way;
NUC, RAM, Sail, Fish, Towing;
Towed & Manned;
Anchored;
Danger/Doubt; and
S.O.S.; and
Horn or Light on continuously.

4. The system for automating the horn/light signaling of marine vessels according to claim 1, further comprising a remote 360 degree LED vessel light connected to said light driver.

5. The apparatus of claim 4, wherein said processor controls and coordinates the operation of the apparatus using interrupt driven firmware stored in said memory.

* * * * *